US007510030B2

(12) United States Patent
Kuckes et al.

(10) Patent No.: US 7,510,030 B2
(45) Date of Patent: Mar. 31, 2009

(54) ELONGATED CROSS COIL ASSEMBLY FOR USE IN BOREHOLE LOCATION DETERMINATION

(75) Inventors: Arthur F. Kuckes, Ithaca, NY (US); Herbert J. Susmann, Ithaca, NY (US)

(73) Assignee: Vector Magnetics LLC, Ithaca, NY (US)

( * ) Notice: Subject to any disclaimer, the term of this patent is extended or adjusted under 35 U.S.C. 154(b) by 0 days.

(21) Appl. No.: 11/819,210

(22) Filed: Jun. 26, 2007

(65) Prior Publication Data

US 2008/0000686 A1 Jan. 3, 2008

Related U.S. Application Data

(60) Provisional application No. 60/817,428, filed on Jun. 30, 2006.

(51) Int. Cl.
*E21B 7/04* (2006.01)
*E21B 44/00* (2006.01)

(52) U.S. Cl. ..... 175/61; 175/45; 166/66.5; 166/255.1; 324/346; 324/207.22; 324/207.26

(58) Field of Classification Search ..... 175/45, 175/61; 166/66.5, 255.1, 255.2; 324/346, 324/207.22, 207.23, 207.26
See application file for complete search history.

(56) References Cited

U.S. PATENT DOCUMENTS

| | | | | |
|---|---|---|---|---|
| 3,714,416 | A * | 1/1973 | Link et al. | 250/398 |
| 3,731,752 | A * | 5/1973 | Schad | 175/45 |
| 5,103,920 | A * | 4/1992 | Patton | 175/45 |
| 5,394,131 | A * | 2/1995 | Lungu | 335/229 |
| 5,923,170 | A | 7/1999 | Kuckes | |
| RE36,569 | E * | 2/2000 | Kuckes | 324/346 |
| 6,466,020 | B2 * | 10/2002 | Kuckes et al. | 324/326 |
| 6,814,163 | B2 * | 11/2004 | Kuckes | 175/45 |
| 6,927,741 | B2 | 8/2005 | Brune et al. | |
| 7,219,749 | B2 * | 5/2007 | Kuckes | 175/45 |
| 2008/0007260 | A1 * | 1/2008 | Reiderman | 324/303 |

* cited by examiner

*Primary Examiner*—Shane Bomar
(74) *Attorney, Agent, or Firm*—Jones, Tullar & Cooper, P.C.

(57) ABSTRACT

A pair of elongated crossed coils is deployed in a first borehole and an instrument containing magnetic field sensors is deployed in a second borehole. The crossed coils are energized in quadrature by AC currents producing a rotating, elliptically polarized magnetic field at the second borehole. Mathematical analysis of the magnetic field sensor readings determines the location of the second borehole relative to the first. Both the distance and the rotational direction to the second borehole are determined as a function of depth of the sensors relative to that of the pair of crossed coils. Twisting of the long coil in the borehole is evaluated and the relative distance between the boreholes and the corrections needed due to such twisting are determined.

17 Claims, 9 Drawing Sheets

ELONGATED CROSS COIL ASSEMBLY FOR USE IN BOREHOLE LOCATION DETERMINATION

BACKGROUND

This application claims the benefit of U.S. Provisional Application No. 60/817,428, entitled "Long Coil Pair for Tracking the Drilling of a Borehole", filed Jun. 30, 2006, the disclosure of which is hereby incorporated herein by reference.

The present invention relates, in general, to a method and apparatus for measuring the relative locations of boreholes and for drilling boreholes that are accurately placed relative to each other. More particularly, the invention relates to a drilling guidance tool that is deployed in an existing reference borehole, the tool incorporating a coil assembly having an elongated core carrying a pair of elongated crossed coils that are energized with alternating current so as to produce a rotating, elliptically polarized magnetic field. An instrument containing magnetic field sensors is deployed in a second borehole that is being drilled to measure the rotating magnetic field and to track and to guide the drilling.

The technology for accurately tracking and drilling boreholes in a known location in the Earth using electromagnetic techniques has been well developed over the years. Also, methods exist for accurately tracking and drilling boreholes that are to be positioned relative to existing boreholes in areas where direct measurement from the surface is not possible. One example of such methods uses a long solenoid coil deployed in an existing borehole to generate a known magnetic field (either DC or AC). The magnetic field generated by this coil is measured in the second borehole, and these measurements are used to calculate the position of the second borehole relative to the first. Another method uses a long thin coil of wire wrapped lengthwise around a section of plastic pipe in the existing borehole. Measurements of the orientation of this coil along with measurements of the magnetic field produced by the coil in the borehole being drilled are used to compute the position of the second hole. However, problems exist with these and other current methods. For example, when using a solenoid coil to produce the magnetic field that is to be measured, the solenoid must be continuously moved along the first borehole as the second is being drilled; generally it must be moved for each new position measurement. Methods using long thin axial coils allow several distance measurements to be taken before the coil must be moved, but it is necessary to know the rotational orientation of the long thin coil in order to compute the second borehole location. Measuring or setting this rotational orientation is often difficult, in practice, and this adds to the complexity and cost of the drill guidance system.

Numerous patents exist that disclose the use of electromagnetic sources in a reference borehole in the Earth to track and to guide the drilling of a second borehole. For example, U.S. Pat. No. 3,853,185 to Dahl discloses the use in a reference borehole of a loop antenna excited by radio frequency (RF) alternating current and the use of another antenna on drilling apparatus in a second borehole to receive the generated signal. Both direction and distance to the reference well from the borehole being drilled are determined from the received signals. In addition, U.S. Pat. No. 6,927,741, to Brune et.al., discloses the use of a transmitting loop antenna, a mechanism for measuring the roll angle of the transmitting loop, and magnetic field receivers to measure the generated electromagnetic field components to determine the relative orientation of, and the distance between, the transmitting loop and the receivers. In still another example, U.S. Pat. No. 5,923,170 to Kuckes discloses the use of an arbitrary wire loop of known configuration, including a loop with wire segments in a borehole. U.S. Pat. No. 4,875,014 to Roberts et al discloses another method of using loops on the ground for determining drilling location, as does U.S. Pat. No. 3,589,454 to Coyne. U.S. Pat. No. 5,589,775 to Kuckes discloses the utility of the ellipticity of the rotating electromagnetic field produced by a rotating magnet to track the drilling of a borehole.

One prior approach to measuring the rotational orientation of a long coil has been to deploy a tilt-sensing instrument with the coil. Such a tilt sensor measures the angle between the plane of the coil and the direction of gravity. A problem with this approach is that it does not work at all for vertical holes. In such cases, the rotational orientation of the coil must be determined; for example by connecting a rigid structure (such as a pipe) to the coil and measuring the rotational position of the pipe at the surface of the Earth. This can be problematic in practice, however, since the rigid structure may twist as it goes down into the borehole, making it difficult to accurately measure the rotation angle of the coil with respect to some fixed point on the surface.

Accordingly, there is a need to be able to measure the location of a second borehole relative to an existing first borehole which avoids the foregoing and other problems encountered in the use of current drill guidance equipment.

SUMMARY OF THE INVENTION

The present invention overcomes the difficulties encountered in the use of prior drill guidance systems by providing an improved method and apparatus for tracking and drilling boreholes along predetermined paths, typically, but not only, when the borehole is to be accurately placed with respect to the path of another existing borehole. The method and apparatus of the invention include the use of an elongated pair of crossed coils that are deployed, for example, in the existing borehole. Both coils are energized with alternating current in such a way as to produce a rotating magnetic moment that generates a rotating, elliptically polarized magnetic field at the observation point in the borehole being drilled or surveyed. Measurements of this magnetic field are made at the observation point, in accordance with the preferred embodiment of the invention, using a magnetic sensor located in a drilling tool that preferably is located near the drill bit in the second borehole; i.e., the borehole that is being drilled. Mathematical analysis of these measurements at a single drill bit location suffices to determine the principal (major) axis of the elliptical field. Thereby the radial and axial position of the magnetic field sensors in the second borehole relative to the principle (major) axis of the elliptical field and to the center of the crossed coil assembly in the first borehole is determined without the need to determine the roll angle of the field source. The effect of twisting of the long coil is evaluated and corrected for by measuring and analyzing the relative phase of the electromagnetic fields measured as a function of depth.

It will be understood that the crossed coil assembly need not be deployed in a borehole for the system to be useful. In some cases it may be desirable to place the assembly on the surface of the Earth or on the bottom of a river or lake to provide the guidance magnetic field for a borehole being drilled, in which case the crossed coils will function the same as if they were in a borehole to enable the borehole being drilled to be guided along a desired path with respect to the location of the crossed coils. The method and apparatus disclosed herein are also useful for surveying location of one borehole relative to another.

The measurements and data generated by the method and apparatus of the invention provide a unique guidance system for drilling one or more boreholes relative to an existing borehole or to a predetermined path defined by the crossed coil assembly.

BRIEF DESCRIPTION OF THE DRAWINGS

The foregoing, and additional objects, features and advantages of the present invention will become apparent to those of skill in the art from a consideration of the following detailed description of preferred embodiments thereof, taken in conjunction with the accompanying drawings, in which.

DETAILED DESCRIPTION OF PREFERRED EMBODIMENTS

Figure 1:
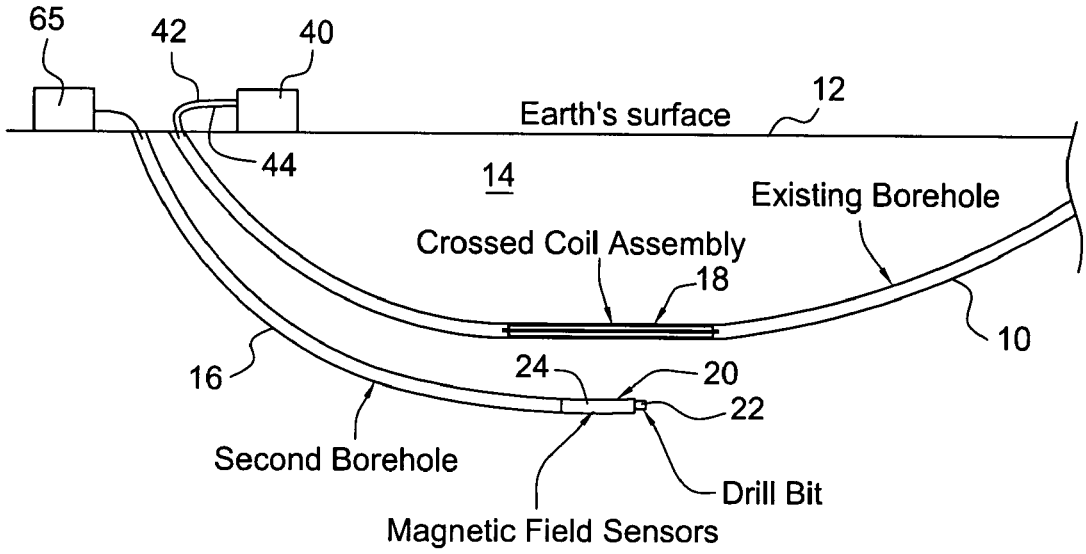
FIG. 1 is a diagram illustrating an existing borehole with a pair of crossed coils deployed in it and a second borehole being drilled in a measured proximity to the existing borehole.

Turning now to a more detailed description of a preferred embodiment of the present invention, FIG. 1 illustrates a method and apparatus for measuring the relative locations of a borehole that is being drilled and an elongated magnetic field source. As illustrated, the field source may be located in an existing first borehole 10 that is located beneath the surface 12 of the earth 14 and a second borehole 16 is to be drilled along side the existing borehole. A crossed coil assembly, generally indicated at 18, is deployed in the existing borehole to provide a magnetic field for guiding the drilling of borehole 16, and a drilling tool 20, incorporating a drill bit 22 and conventional drilling control equipment, as well as suitable magnetic field sensors 24 for detecting the magnetic field produced by the crossed coil assembly, is located in borehole 16. The coil assembly 18 is positioned in the borehole 10 either with cables pulling it from either end of the existing borehole or by mounting it on the end of a long pipe or drill stem and pushing and/or pulling it into position from either end of the borehole. Alternatively, a motorized well tractor can be deployed to crawl forwards or backwards in the borehole, pushing or pulling the coil assembly with it.

Figure 2:
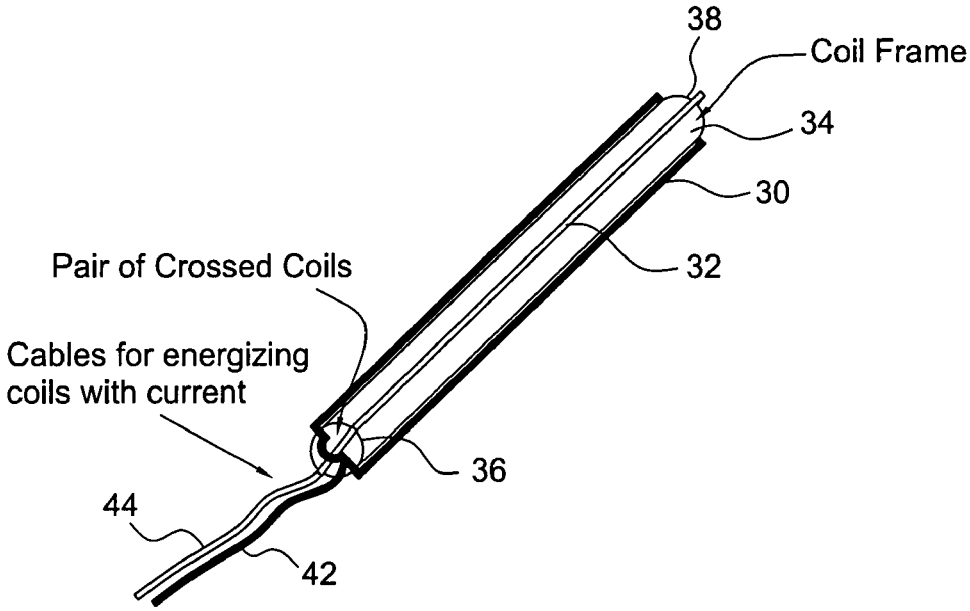
FIG. 2 is a diagrammatic perspective illustration of a pair of crossed coils used in the guidance system of FIG. 1, with the coils mounted on a cylindrical pipe, typically made of plastic.
Figure 3:
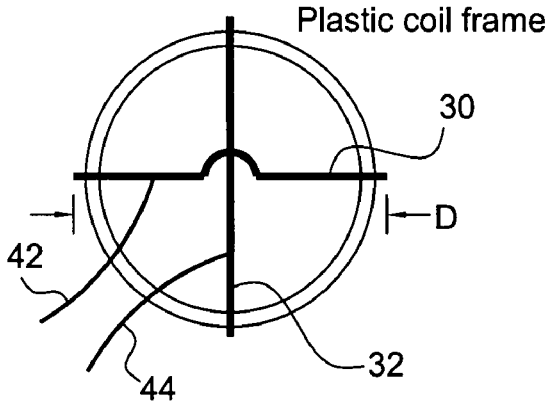
FIG. 3 is a diagrammatic illustration of an end view of the crossed coil assembly of FIG. 2.

As diagrammatically illustrated in FIGS. 2 and 3, the coil assembly 18 consists of a pair of elongated coils 30 and 32 wrapped lengthwise, or axially, on an elongated coil frame 34. As illustrated in FIG. 2, the coils 30 and 32 are positioned, or wound, on frame 34 so that the planes of the two coils are 90° apart around the circumference of the frame and therefore at right angles to each other where they cross at the ends 36 and 38 of the frame, as illustrated in FIG. 3. The frame 34 may be a tube formed of a nonmagnetic material such as plastic, for example, and the coils are formed on the frame as by wrapping one or more turns of insulated wire axially along the pipe for each of the crossed coils. In one example of such a coil, the length of the frame was about 20 meter and its diameter was 0.1 meter, with each coil having 10 turns and, when energized, each coil carried a current of about 6 amperes. The coils may be secured on the frame by nylon ties and wrapped in tape or potted in epoxy to hold them in place. For maximum protection the assembly can be covered with a larger tube of a nonmagnetic material. The frame may be grooved along its length to facilitate the winding of the coils and to ensure that they maintain their relative orientation on the frame.

The crossed coils are separately energized with AC current supplied from a source such as a generator 40 (FIGS. 1 and 5) at the earth's surface, coils 30 and 32 being connected to the generator by way of respective supply cables 42 and 44. The energized coils produce corresponding magnetic fields in the earth surrounding the borehole 10 and extending sufficiently far radially outwardly to intersect and to be measureable at the path to be followed by the borehole 16. The current supplied to the coils is synchronized so as to produce a rotating magnetic moment in the surrounding magnetic field of the source. Although the current source 40 is illustrated as being located on the surface of the earth and connected to the crossed coil assembly by cables 42 and 44, it will be understood that the current source can be located with the crossed coil in the borehole and that the entire assembly can be powered by batteries or some other independent power source.

Figure 4A:
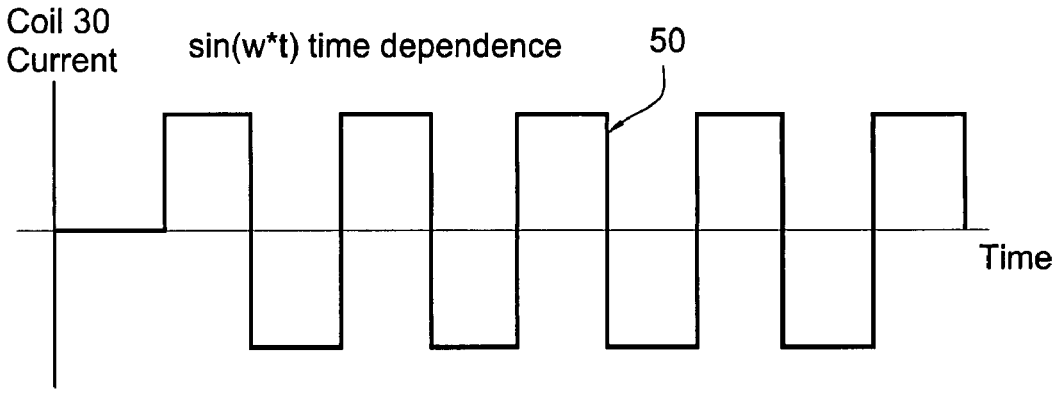
FIGS. 4(*a*) and 4(*b*) diagram the relationship between the currents in the two coils of the crossed-coil system assembly of FIG. 2.
Figure 4B:
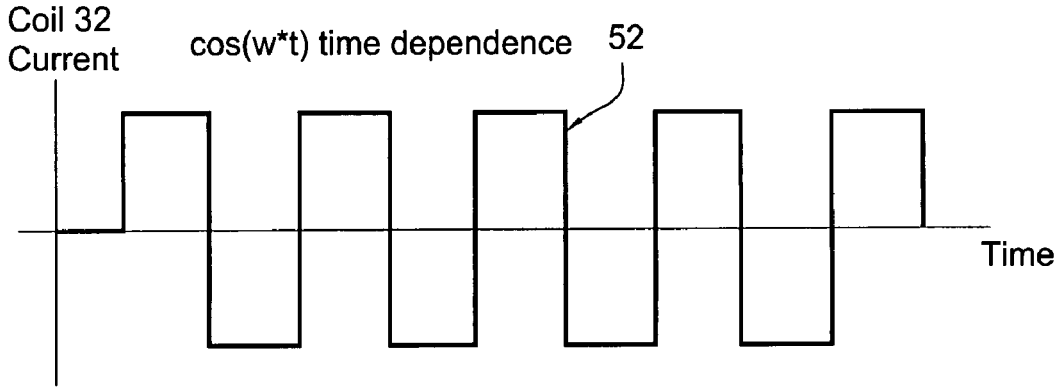

The current generator 40 produces two synchronized alternating currents, one for each of the two coils 30 and 32 in the assembly, and these currents are in time quadrature with respect to each other, as illustrated by curves 50 and 52 in FIGS. 4(*a*) and 4(*b*). As illustrated, one of the coils, for example coil 30, carries current that varies temporally as a sine function, while the other coil, for example coil 32, carries current that varies temporally as a cosine function. Alternatively, the current waveforms in coils 30 and 32 can be square waves whose fundamental Fourier components vary as the sine and cosine, respectively. Generally, it often is easier, in practice, to produce square waves rather than pure sinusoidal waves, with the measured data from the resulting magnetic fields then being Fourier analyzed to determine the sinusoidal component of interest. A suitable current generator of this type is a pair of Paratrack power supplies, manufactured by Vector Magnetics LLC, of Ithaca, N.Y.

Figure 5:
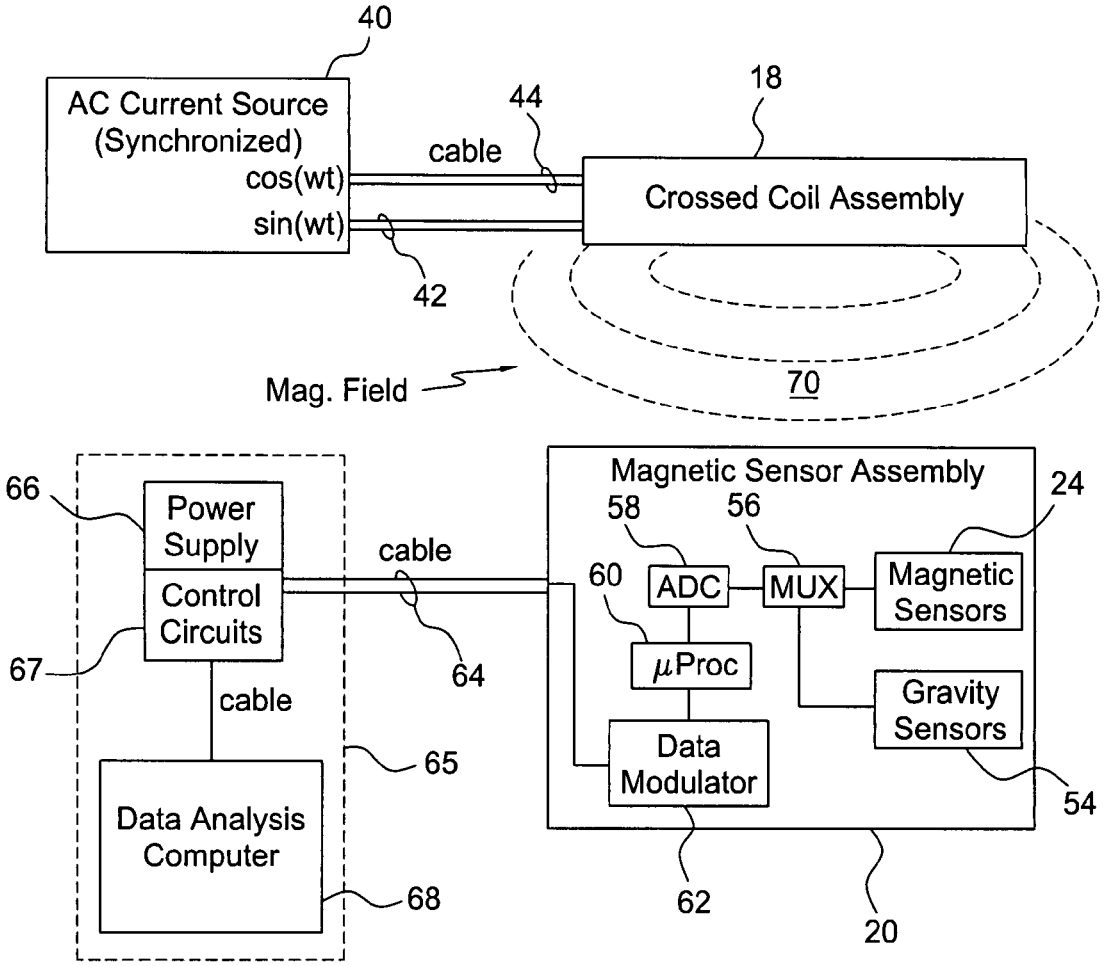
FIG. 5 is an overall block diagram of the entire system of the invention, illustrating a crossed-coil assembly, its power supply, a magnetic field sensor instrument package, its power supply, and a data analysis computer, and illustrating the synchronized power supply used to drive the coils in the crossed coil assembly of FIG. 2.

As illustrated in FIG. 5, the drilling tool 20 incorporates the magnetic field sensor, or field detector, 24 that is used to detect the magnetic field produced by the crossed coils in assembly 18. This sensor preferably is an instrument that includes a magnetometer that measures three orthogonal vector components of the surrounding magnetic field. Tool 20 may also include detectors, such as three gravity sensors 54, for measuring vectors of the earth's gravity. A suitable drilling tool of this type is the Vector Magnetics Steering Tool, manufactured by Vector Magnetics LLC, of Ithaca N.Y.

The drilling tool 20 in borehole 16 preferably also incorporates a suitable power supply, as well as a multiplexer 56, an analog to digital converter 58, a microprocessor 60, and a suitable data modulator for transferring sensed data uphole by way of a cable 64 to a surface drill controller 65 that includes a power supply 66, control circuitry 67, and a suitable data analysis computer 68 that is programmed to calculate the location and direction of tool 20 with respect to the crossed coil assembly 18. This computer is used to control the direction of drilling of the borehole 16 in response to the measurements made by the magnetic field sensors and by the gravity sensors, as is known in the art of borehole drilling. For this purpose, the assembly 18 is positioned in borehole 10 at a location where the magnetic field 70 (FIG. 5) generated by energizing the crossed coil assembly can be detected at the drilling tool 20 in the borehole 16 being drilled. Since the borehole is to be drilled along a path having a specified relationship to the path of the existing borehole, for example, parallel to it and spaced apart from it by a specified distance, a precise determination of the distance and the direction to the crossed coil assembly 18 in the existing borehole from tool 20 is made periodically, and the direction of subsequent drilling is controlled from the drill controller 65. Measurements are made periodically and the location of the assembly 18 and the direction of drilling are adjusted as needed to enable the borehole 16 to follow the desired path. In the following detailed discussion of the process for determining the desired direction in which the borehole 16 is to be drilled after each measurement, the notation follows closely that of the MATLAB programming language. Specifically, the function unitvec(x) returns a unit vector from its input vector argument x, and the function mag(x) returns the scalar magnitude or length of its vector argument x. The function cross(x,y) returns the cross product of its two vector arguments x and y.

Figure 6:
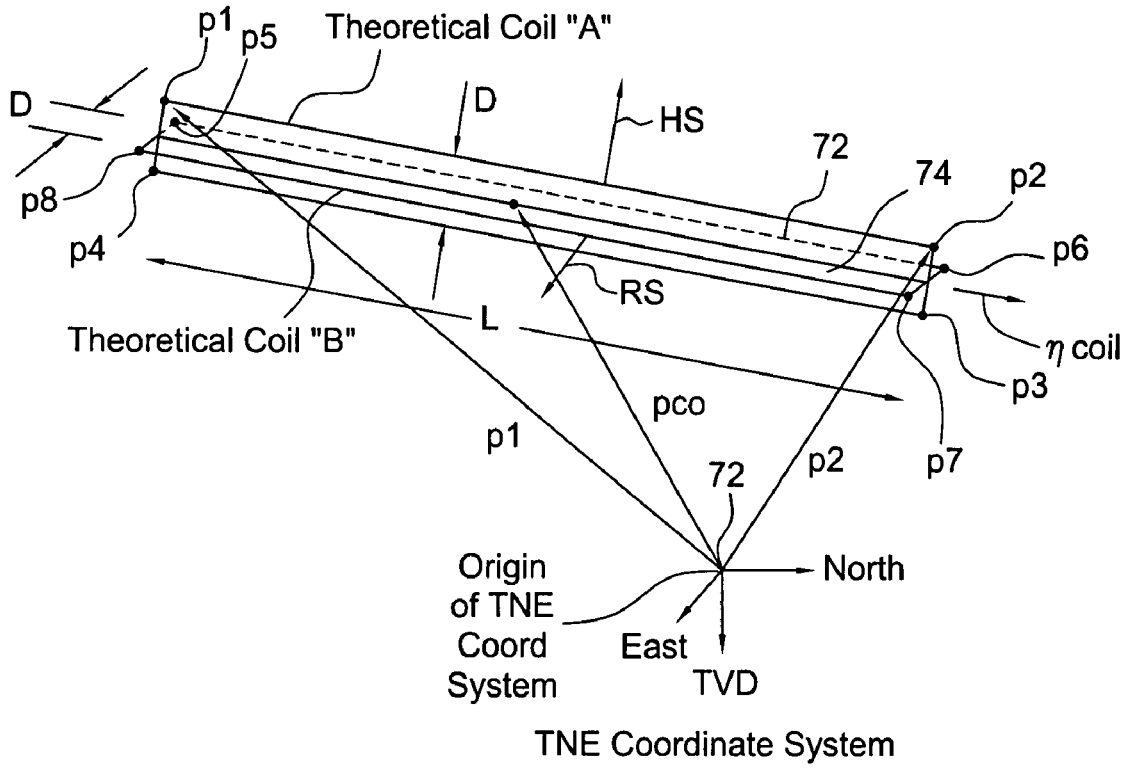
FIG. 6 is a diagram illustrating the parameters of a mathematical model of the crossed coil assembly of FIG. 2, including theoretical coils "A" and "B" and the vertex vectors of these coils.

A mathematical analysis of the vector of the magnetic field produced by coil assembly 18 and measured at the location of sensor 24 is required in order to determine the distance and direction of the field source from the sensor, and thus to permit the operator of the system to determine whether the borehole 16 is following the predetermined track with respect to the existing borehole 10. This analysis involves first constructing a mathematical model of the measured field 70. The model starts with defining a theoretical coil "A" and a theoretical coil "B" that are oriented at right angles to each other as shown, for example, in FIG. 6. For convenience of analysis, position vectors, or coordinates, p1, p2, and similarly constructed vectors p3 and p4, define coil A, while similar position vectors, or coordinates p5, p6, p7 and p8, define coil B as illustrated in FIG. 6. In general, there need not be physical coils with vertices at the locations given in the model; these coordinates are chosen out of convenience and are defined such that the coil "A" lies in a plane 72 that is illustrated in the Figure as being generally vertically oriented and is defined by a High Side unit vector HS and a coil direction vector ncoil which is along the axis of the coil, while coil "B" lies in a plane 74 that is illustrated in the Figure as being generally horizontally oriented and is defined by a Right Side unit vector RS and the coil direction vector ncoil. The coil axis direction vector is illustrated in the Figure as ncoil.

Coil "A" and coil "B" are theoretical constructs used to create a model of the system illustrated in FIG. 1. In the illustrated system, a magnetic field 70 is generated by a rotating magnetic moment of crossed coils 30 and 32, which coils are energized by AC currents in quadrature. In utilizing the system of FIG. 1, the exact physical locations of the actual coordinates of coils 30 and 32 are never measured, nor are they needed for the following mathematical analysis of the system. Because coil 30 is energized with a current that varies as the sine with respect to time and coil 32 is energized with a current that varies as the cosine with respect to time, the calculated magnetic moment of a theoretical system modeled from coils "A" and "B" will be the same as the actual moment generated by the rotated coils 30 and 32 of the crossed coil assembly 18 discussed above, except for a time shift t0 that will be discussed below with respect to the mathematical model.

Proceeding with the analysis of the theoretical system, a three-dimensional Cartesian coordinate system TNE (TVD, North, East) is defined. In the TNE system, T is the true vertical direction (TVD); i.e., is the gravity direction, while N is North, which is perpendicular to TVD, and points toward the local magnetic North direction as defined by the earth's magnetic field. E is East, which is perpendicular to both TVD and North. The direction vector ncoil and the coil position vector pcoil (FIG. 6) are both known from a survey of the existing borehole 10, as calculated from the origin 72 of the TNE system, using standard survey methods, and both of these vectors are in the TNE coordinate system. In addition, the length L and width D dimensions of the crossed coil assembly 18 are known.

The first step of the analysis is to calculate the values of the vectors HS and RS in the TNE coordinate system from the horizontal vector v that is perpendicular to both the ncoil direction and the TVD direction as follows:

$$v=\text{unitvec}(\text{cross}(n\text{coil},(100))) \quad \text{(Eq. 1)}$$

and then $$HS=\text{cross}(n\text{coil},v) \quad \text{(Eq. 2)}$$

$$RS=\text{cross}(n\text{coil},HS) \quad \text{(Eq. 3)}$$

where v is the horizontal vector perpendicular to the axis of the coil assembly, "cross" is a vector cross product, ncoil is the unit vector of the coil assembly axis in borehole 10, as illustrated in FIG. 6, "(100)" is a unit vector in the TVD direction, also as illustrated in FIG. 6, HS is a unit vector in the "High Side" direction of the existing borehole 10, and RS is a unit vector in the "Right Side" direction of borehole 10. Then the value of cp1, which is the horizontal vector perpendicular to the axis of the coil assembly, is computed, as follows:

$$cp1=\text{mag}(\text{Cross}(n\text{coil}, (100))) \quad \text{(Eq. 4)}$$

If cp1 is not zero then vector v is computed again.

If cp1 is zero, then instead HS and RS are taken as:

HS=North

RS=East

This is the case of a vertical borehole and the High Side direction is arbitrarily taken to be the North axis direction and the Right Side direction is arbitrarily taken to be the East axis direction.

From the known coil length L and coil width D, coordinate vectors p1, p2, p3, and p4, are formed, all in the TNE coordinate system, from:

$$p1=p\text{coil}-(L/2)*n\text{coil}+(D/2)*HS \quad \text{(Eq. 5)}$$

$$p2=p\text{coil}+(L/2)*n\text{coil}+(D/2)*HS \quad \text{(Eq. 6)}$$

$$p3=p\text{coil}+(L/2)*n\text{coil}-(D/2)*HS \quad \text{(Eq. 7)}$$

$$p4=p\text{coil}-(L/2)*n\text{coil}-(D/2)*HS \quad \text{(Eq. 8)}$$

These coordinate vectors are the corners of the imaginary coil A that is oriented in the ncoil-HS plane and centered on the coil coordinate vector pcoil, as illustrated in FIG. 6. The vector pcoil is the position vector of the center of the crossed coil assembly from the origin of the TNE coordinate system.

The vectors p5, p6, p7, p8 are now formed, again in the TNE coordinate system, as follows:

$$p5=p\text{coil}-(L/2)*n\text{coil}-(D/2)*RS \quad \text{(Eq. 9)}$$

$$p6=p\text{coil}+(L/2)*n\text{coil}-(D/2)*RS \quad \text{(Eq. 10)}$$

$$p7=p\text{coil}+(L/2)*n\text{coil}+(D/2)*RS \quad \text{(Eq. 11)}$$

$$p8=p\text{coil}-(L/2)*n\text{coil}+(D/2)*RS \quad \text{(Eq. 12)}$$

These are the vertices of the imaginary coil B that is in the ncoil-RS plane and is perpendicular to coil A, as illustrated in FIG. 6.

The law of Biot-Savart is used with finite length current segments to find the magnetic field HA generated from the four straight coil segments of coil A and, separately, the magnetic field HB generated by the four straight coil segments of coil B. A normalized current of 1 amp in each coil is assumed, for now. A model of the expected AC magnetic field at a magnetic sensor located at a theoretical sensor point pObs in the TNE coordinate system is constructed using the fields calculated for Coil A and Coil B above. Then a time varying theoretical field Htheor is constructed from:

$$H\text{theor}(t)=I*(HA*\cos(w*(t-t0)+HB*\sin(w*(t-t0))) \quad \text{(Eq. 13)}$$

where I is the actual peak current in each coil, with each coil carrying the same peak current.

The actual measured magnetic field vector Hmeas(t) at the observation point is then compared with Htheor(t) and parameters t0 and pObs are varied until the total squared error between the measured and theoretical fields is minimized:

$$\text{Err}=\text{norm}(\text{sum}((H\text{theor}(t)-H\text{meas}(t))^2) \quad \text{(Eq. 14)}$$

A number of numerical methods for finding the minimum error Err can be chosen. One method is the Nelder-Mead Simplex algorithm, implemented in MATLAB by the fminsearch function. For a starting estimate of the magnetic sensor coordinate, pObs, a best guess coordinate based on the conventional survey (from inclination and azimuth measurements of the borehole being drilled) is used. For the initial estimate of t0, Err is evaluated at the initial pObs estimated location for 8 equally spaced values of t0 ranging from 0 to T, where T is the period of the AC excitation current. The value of t0 that results in the minimum value of Err is picked. The Nelder-Mead search algorithm further refines these estimates of t0 and pObs to find the values that minimize Err. This final pObs is the computed position coordinate of the magnetic sensor in the borehole being drilled.

Figure 7:
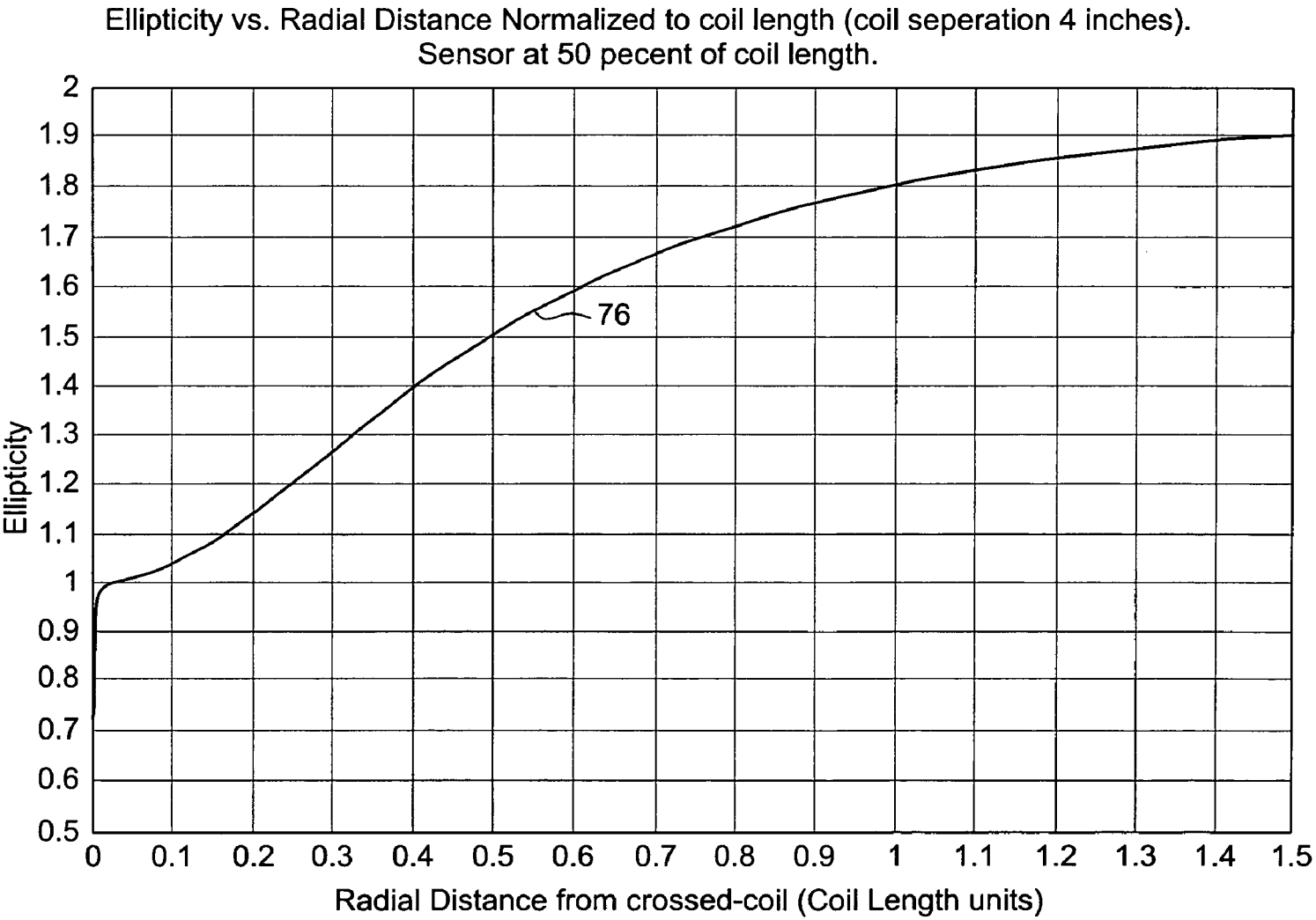
FIG. 7 is a graphical plot of the ellipticity of the AC magnetic field generated by alternating currents in a cross-coil assembly 50 meters long with a diameter of 4 inches, where the horizontal axis of the graph is the radial distance away from the coil assembly normalized to the coil length, the plot being made at an axial distance along the crossed coil assembly that is midway down the assembly.
Figure 8:
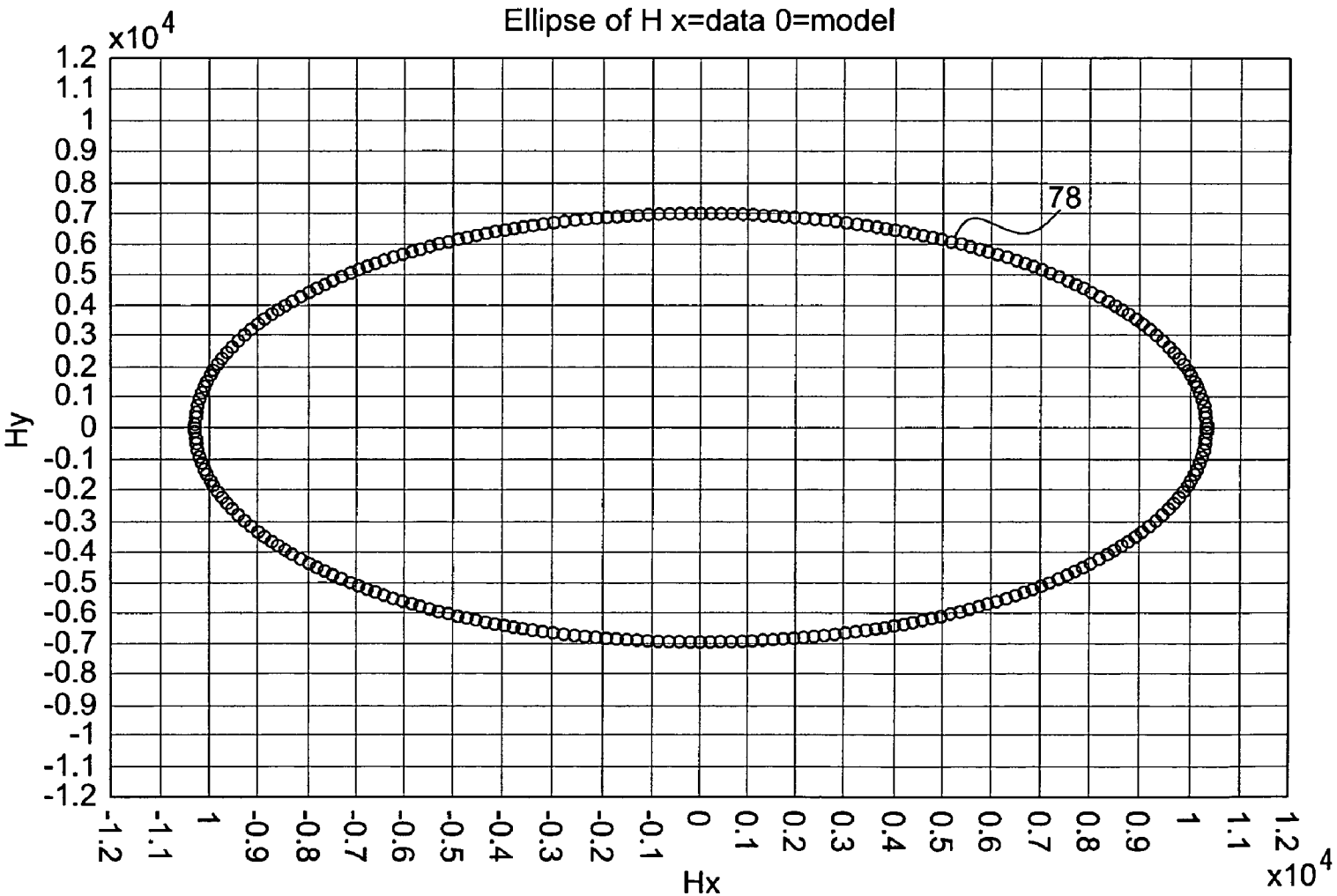
FIG. 8 is a graphical plot of the AC magnetic field received at orthogonal magnetic sensors and plotted as Hy vs. Hx to show the ellipticity of the field, the crossed coil length in this case being 20 m with the magnetic sensors being 10 meters radially away opposite the center of the coil assembly, the z axis of the sensor being aligned parallel to the crossed coil assembly.

The convergence of the above method relies on the ellipticity of the rotating magnetic field Htheor(t). Ellipticity is defined as the maximum peak AC magnetic field value divided by the minimum value. Models of typical geometries used in practice show that the field is always at least somewhat elliptically polarized for practical crossed coil lengths and typical sensor-to-coil separations. Ellipticities of even 5% are sufficient to provide accurate and robust position measurements. FIG. 7 shows at curve 76 the modeled ellipticity vs. radial distance away from a crossed coil. The crossed coil width D (FIG. 3) was assumed to be 4 inches for this analysis, which is a typical value that is used in practice. From FIG. 7 it is seen that at observation point distances from about 0.1 coil lengths radially outwardly from the axis of the crossed coil assembly, the ellipticity is sufficient to provide accurate position measurements. For a 50 m coil length this means that one can get an accurate measurement from as close as 5 m to the coil. For a 20 m coil length, distances down to 2 m are measurable. FIG. 8 is a graphical plot 78 of the AC magnetic field received at orthogonal magnetic sensors and plotted as Hy vs. Hx to show the ellipticity of the field, the crossed coil length in this case being 20 m with the magnetic sensors being 10 meters radially away opposite the center of the coil assembly, the z axis of the sensor being aligned parallel to the crossed coil assembly. In general, the coil can be made shorter to enable even closer distances to be measured.

As the axial position of the sensors 24 relative to the longitudinal center of the crossed coil assembly 18 moves away from a position half-way along the coil, the ellipticity increases slightly also. The practical upper limit of distance measurement is about 50 meters from the assembly 18, if one assumes a 50 meter long coil assembly, a 60 amp-turn coil current (6 amps and 10 turns of wire on each coil), and magnetic noise typical of drilling environments. Longer ranges are possible if more amp-turns of current is used, or if more signal averaging is done on the received magnetic field measurements; however, it becomes impractical at some point to keep increasing the field strength in this way, as the magnetic field falls off rapidly with distance due to the dipole nature of the source and the ultimate $1/r^3$ falloff of the field. Signal averaging improves the measurement only as the square root of the number of samples analyzed and at some point becomes impractical due to the long measuring times involved.

Note that there is always a 180 degree ambiguity as to which side of the crossed-coil assembly 18 the sensors 24 are on. Because no absolute time synchronization is used between the crossed coil power supply signals and the magnetic sensor sampling times, one cannot tell just from the data which side of the coil the sensor is on. Fortunately, this is not a problem in practice, since the operator always knows at least generally which side of the coil he is on, based on the conventional inclination/azimuth surveys of the drill bit location and on previous measurements further up the borehole.

One could add time synchronization between the AC power supply and the magnetic sensor sampling times to eliminate the foregoing 180 degree ambiguity with the only added complication that the gross rotational positioning of the crossed-coil assembly would then have to be done with only ±90 degree accuracy. In practice it is easier to rely on prior knowledge of which side of the coil the sensor is on than to try to do this with time synchronization between the coil and the magnetic sensor.

The following is a more detailed explicit mathematical exposition of the method described above, with reference to FIG. 9. Consider the magnetic field at a point P located on a plane 79 that is perpendicular to the axis of a long coil 80 and generated by the coil, where the coil lies in a plane 82 defined by an axis n and a perpendicular direction m, with the coil carrying an electric current I. Field vector components in the r and q directions lying in plane 79 can be written approximately, if R>>w, where R is the radial distance from the center 83 of the coil 80, and w is the coil width, which is the case of interest, as $$Hr=(I*w*HR/4*pi*R^2))*\sin(Amr) \quad \text{(Eq. 15)}$$

$$Hq=(I*w*HQ/4*pi*R^2))*\cos(Amr) \quad \text{(Eq. 16)}$$

where HR and HQ are constants, and where Amr is the angle between the directions of m and R.

Figure 10:
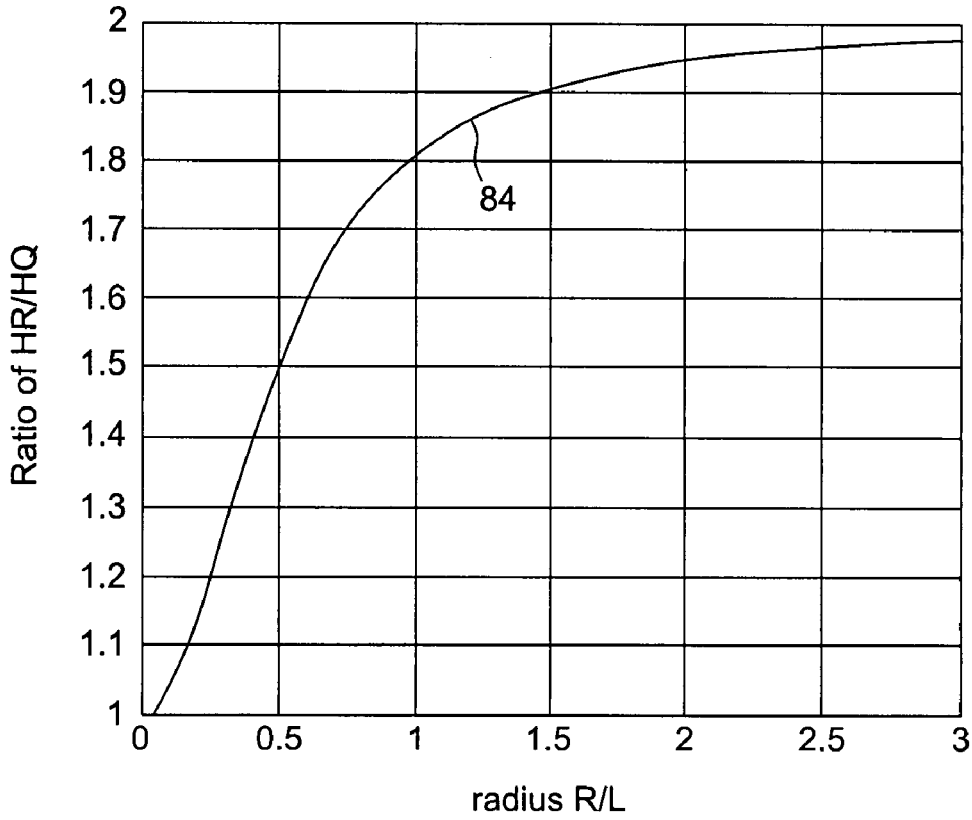
FIG. 10 is a graphical plot of the ratio of HR to HQ vs R/L at the center of the coil shown in FIG. 9.
Figure 11:
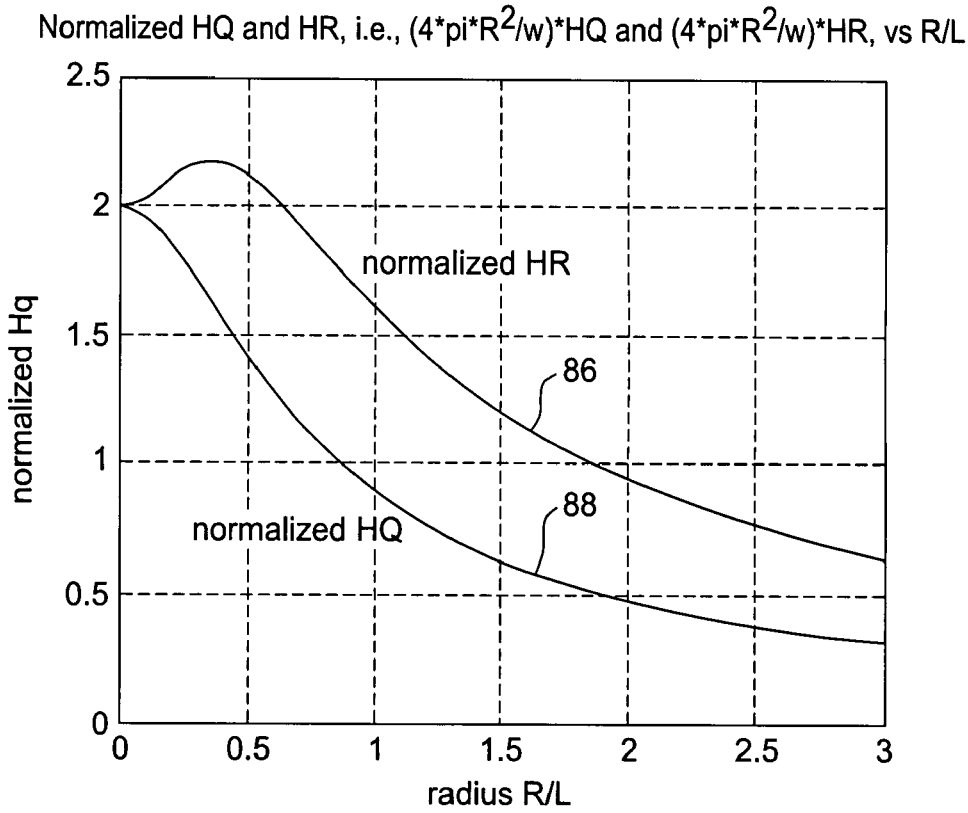
FIG. 11 is a plot of the normalized parameters HR and HQ associated with FIG. 10.

The constants HR and HQ are readily computed for a given coil geometry, location along the axis of the coil, and radial distance parameter R. The present discussion relates mainly to determining the direction to the magnetic field source from an observation point; thus, the exact values of HR and HQ are not vital; the important point is that they are different. The ratio of HR/HQ is shown by curve 84 in FIG. 10 as a function of R/L at the center of the coil, where L is the length of the coil. For thin coils; i.e., where R>>w, which is the case of interest, then HR/HQ is close to 1 for very small values of R/L and HR/HQ increases rapidly toward an asymptotic value of 2 for R/L>0, as illustrated in FIG. 10. The dependence of HR, illustrated by curve 86, and HQ, illustrated by curve 88, as functions of the ratio R/L at the longitudinal center of the coil 80 of FIG. 9 is shown in FIG. 11.

Figure 9:
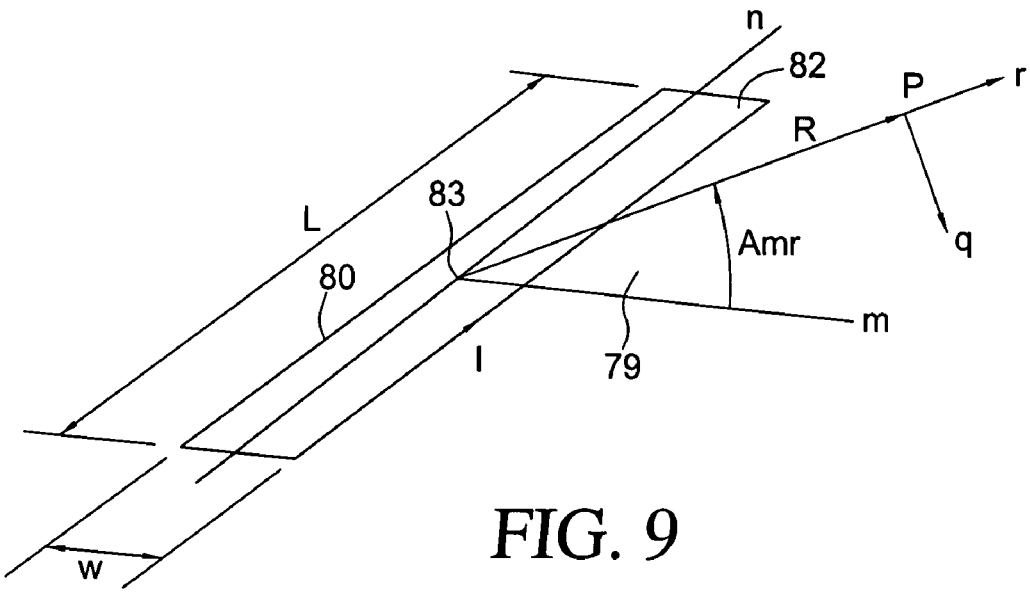
FIG. 9 is a schematic illustration of the mathematical definitions associated with a single coil.
Figure 12:
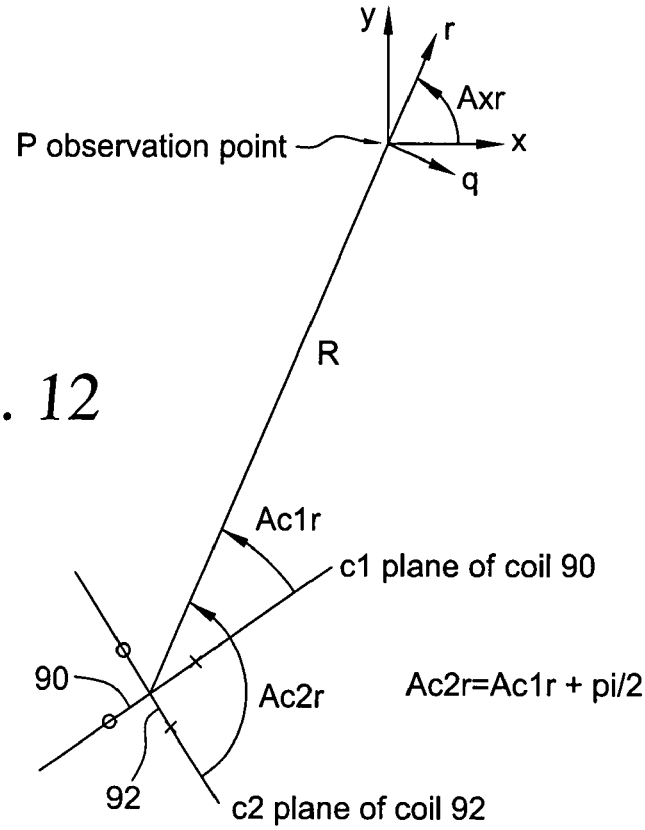
FIG. 12 is a schematic illustration of the mathematical definitions associated with a two-coil system.

Consider the field at the point P (observation point), shown in FIG. 12, that is generated by two identical crossed coils 90 and 92, shown in end view in the Figure, with each being similar to the coil 80 illustrated in FIG. 9 and lying in planes c1 and c2, perpendicular to each other. The field components Hr and Hq generated by current flow in these coils are given by:

$$H1r=(I1*a*HR/4*pi*R^2))*\sin(Ac1r) \quad \text{(Eq. 17)}$$

$$H1q=(I1*a*HQ/4*pi*R^2))*\cos(Ac1r) \quad \text{(Eq. 18)}$$

$$H2r=(I2*a*HR/4*pi*R^2))*\cos(Ac1r) \quad \text{(Eq. 19)}$$

$$H2q=((I2*a*HQ/4*pi*R^2))*(-\sin(Ac1r)) \quad \text{(Eq. 20)}$$

if the current I for coil c1=I*cos(w*t) and for coil c2=I*sin (w*t).

The net field components Hr and Hq are given by:

$$Hr = (I*a*HR/4*pi*R^2))*\sin(w*t+Ac1r) = (I*a*HR)/(4*pi*R^2))*\sin(w*t1) \quad \text{(Eq. 21)}$$

and $$Hq = (I*a*HQ/4*pi*R^2))*\cos(w*t+Ac1r) = (I*a*HQ/4*pi*R^2))*\cos(w*t1) \quad \text{(Eq. 22)}$$

where:

$$t1=t+Ac1r/w \quad \text{(Eq. 23)}$$

It is important to note that the angle Ac1r enters only as a phase shift; i.e., as a time shift in the Hr and Hq electromagnetic field components.

These magnetic field components are measured, as shown in FIG. 12, at the point P, using magnetic sensors in the x and y directions. The orientation of these sensors in space is determined by other means, such as by gravity sensors and/or Earth's magnetic field sensors. The Hx and Hy vector components of the magnetic field H as measured by each sensor are given by:

$$Hx=Hr*\cos(Axr)-Hq*\sin(Axr) \quad \text{(Eq. 24)}$$

$$Hy=Hr*\sin(Axr)+Hq*\cos(Axr) \quad \text{(Eq. 25)}$$

Upon inserting the values found for Hr and Hq:

$$Hx=(I*a/(4*pi*R\hat{}2)*(HR*\cos(Axr)*\sin(w*t1)+HQ*\sin(Axr)*\cos(w*t1)) \quad \text{(Eq. 26)}$$

$$Hy=(I*a/(4*pi*R\hat{}2))*(HR*\sin(Axr)*\sin(w*t1I)-HQ*\cos(Axr))*\cos(w*t1)) \quad \text{(Eq. 27)}$$

To find the angle Axr from the data, the first step is to time average (< >) the following three quantities:

$$<Hx*Hx>=(1/2*)(I*a/4*pi*R\hat{}2))\hat{}2*(HR\hat{}2*\cos(Axr)\hat{}2+HQ\hat{}2*\sin(Axr)\hat{}2) \quad \text{(Eq. 28)}$$

$$<Hy*Hy>=(1/2)*(I*a/4*pi*R\hat{}2))\hat{}2*(HR\hat{}2*\sin(Axr)\hat{}2+HQ\hat{}2*\cos(Axr)\hat{}2) \quad \text{(Eq. 29)}$$

$$<Hx*Hy>=(1/2)*(I*a/4*pi*R\hat{}2))\hat{}2*(HR\hat{}2+HQ\hat{}2)*\sin(Axr)*\cos(Axr) \quad \text{(Eq. 30)}$$

From the above the angle Axr can be found from the measurements of Hx and Hy using the relationships:

$$\cos(2*Axr)=(<Hx*Hx>-<Hy*Hy>)/(<Hx*Hx>+<Hy*Hy>) \quad \text{(Eq. 31)}$$

$$\sin(2*Axr)=2*(<Hx*Hy>/(<Hx*Hx>+<Hy*Hy>) \quad \text{(Eq. 32)}$$

Finally, the angle Axr can be found from these two expressions using the 4 quadrant inverse tangent function:

$$Axr=(1/2)*a\tan 2(\sin(2*Axr),\cos(2*Axr)) \quad \text{(Eq. 33)}$$

Noting that the angle 2*Axr found from the a tan 2 function repeats every 2*pi radians gives the conclusion that the actual angle Axr may be either Axr given by equation 35, or that value plus pi radians.

The distance R at the point P lies can be found from:

$$(R/L)\hat{}2/(HR\hat{}2+HQ\hat{}2)=(\mathrm{sqrt}(<Hx*Hx>+<Hy*Hy>))/((I*a/8*pi*L\hat{}2)) \quad \text{(Eq. 34)}$$

Figure 13:
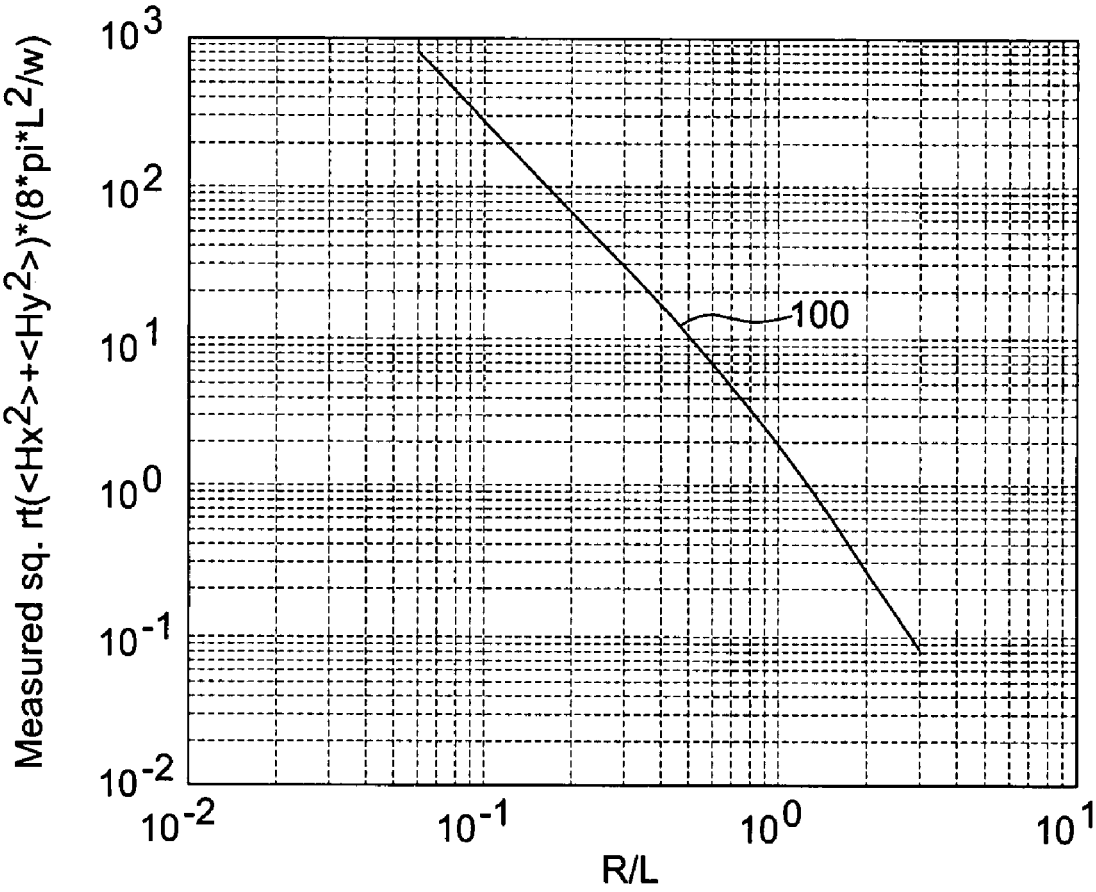
FIG. 13 illustrates the relationship between the distance between the boreholes and the magnetic field measurements.

The results of this are shown at curve 100 in FIG. 13 above.

The above considerations disclose the preferred method for determining the distance and direction from an observation point to the center of a long, narrow coil assembly using magnetic field measurements in a plane perpendicular to the center of that coil. In practice, the coil assembly is positioned in a reference borehole, for example, and the new borehole is tracked for its entire length as it goes past the reference position. The method is useful even beyond the ends of the coil assembly. The salient feature of the present invention is the use of alternating currents in quadrature in substantially identical elongated planar coils that have a common longitudinal axis and that are perpendicular to each other to produce an elliptical magnetic field. The field components are periodically measured at an observation point at or near the drill during the drilling, and magnetic field measurements Hr and Hq at each depth of the borehole being drilled will have the same rotating field property and phase of the field, as shown in equations (21) and (22), if the coils are planar and perpendicular to each other. If the coils are twisted, however, the phase of the measured fields from each coil will change along the depth of observation, since the "effective" angle of the coil Ac1r will change because the coil elements closest to the observation point will have the greatest weight. The curves shown in the above Figures were computed by noting that the narrowness of the coil enables treating the entire coil pair as a superposition of infinitesimal "three" dimensional dipole pairs. Each orthogonal, infinitesimal pair generates a rotating magnetic field with a characteristic phase dependent upon its angular orientation i.e., the Ac1r angle. The expected field intensity for a flat coil pair or a twisted coil pair is readily computed using this method. The calculated field intensity changes as a function of position along the coil pair.

For an untwisted pair, the determination of the radial distance is done exactly as outlined above, though the fields at each depth location must be evaluated. The relative depths of the coil and the sensors along the lengths of the reference borehole and the borehole being drilled, respectively, is usually known precisely; for example, by measurement of the drill pipe lengths and the deployment depth of the coil. The relative depth of the two is also readily determined by analysis of the z component of the generated magnetic field, i.e., the field component along the borehole axis. If the coil is not twisted, then the relative phase of the fields will be the same for all points along the borehole.

The change in the phase of the measured fields as a function of depth is readily modeled to determine numerically the amount of twist. The direction to the neighboring borehole is relatively unaffected, since that depends only upon HR and HQ being different, as examination of Equations 28-30 clearly shows. The magnitude of each does not matter. To determine the distance, however, the magnitude of HR and HQ is important as shown by Equation 34. With the twist modeled from the analysis of the relative phase variation of the fields along the borehole, the variation and magnitude of HR and HQ is readily computed.

Although the present invention has been described in terms of preferred embodiments, it will be apparent to those of skill in the art that the true spirit and scope of the invention is limited only by the following claims.

What is claimed is:

1. Apparatus for guiding the drilling of a borehole in the earth in spaced relationship to a guide borehole in the earth, comprising:

a coil assembly located in the guide borehole, said assembly incorporating an elongated core having a longitudinal axis extending along the guide borehole;

first and second crossed coil windings wrapped longitudinally around said core;

an alternating current source connected to each of said first and second windings to produce separate alternating current flows, whereby each coil generates a corresponding magnetic field at a point in the vicinity of the guide borehole;

sensors in said borehole being drilled for detecting at said point vectors of gravity and vectors of the generated electromagnetic fields; and a controller responsive to the generated magnetic fields and the measured magnetic field vectors to determine the location of the sensors with respect to said first and second crossed coil windings.

2. The apparatus of claim 1, further including a drill tool responsive to said controller to control the direction of drilling of the borehole being drilled with respect to the direction of the guide borehole.

3. The apparatus of claim 1, wherein the crossed coil windings have axes substantially perpendicular to each other and to the axis of said core.

4. The apparatus of claim 1, wherein said alternating current source supplies current to said first and second coils in time quadrature to produce an elliptical, rotating magnetic field at said point.

5. The apparatus of claim 4, wherein the fundamental components of the current in one of said coils vary as a temporal sine function and the fundamental components of the current in the other of said coils vary as a temporal cosine function.

6. The apparatus of claim 1, wherein said currents are synchronized to produce a rotating magnetic moment in the surrounding magnetic field.

7. The apparatus of claim 1, wherein said sensors include a magnetometer for measuring three vector components of the magnetic field surrounding the borehole being drilled.

8. The apparatus of claim 7, wherein said sensors include gravity sensors for measuring vector components of the earth's gravity.

9. The apparatus of claim 8, wherein said controller includes a data analysis computer responsive to the measured magnetic field and the earth's gravity vector components for calculating the location of said sensors with respect to said coil assembly.

10. The apparatus of claim 9, further including a drilling tool in said borehole being drilled responsive to said data analysis computer to control the direction of drilling of the borehole with respect to the direction of the guide borehole.

11. The apparatus of claim 4, wherein the ellipticity of said magnetic field is dependent on the ratio of the length of said core assembly to the radial distance of said sensor from the axis of said core assembly.

12. A method for locating a first borehole in the earth with respect to a guide borehole in the earth, comprising:

positioning a coil assembly at a known location in the guide borehole, said assembly incorporating an elongated core having a longitudinal axis extending along the guide borehole and having first and second crossed coil windings wrapped longitudinally around said core;

supplying a separate alternating current to each of said first and second windings to produce alternating current flow in each coil to generate corresponding magnetic fields at a point in the vicinity of the guide borehole;

detecting in said first borehole vectors of gravity and vectors of the generated electromagnetic fields; and determining the location of the sensors in the first borehole with respect to the location of the coil assembly in the guide borehole in response to the generated magnetic fields and the measured magnetic field vectors.

13. The method of claim 12, further including supplying said alternating currents in time quadrature to said first and second windings.

14. The method of claim 12, wherein determining the location of the sensors with respect to the location of the coil assembly includes determining the distance and direction of the coil assembly from the sensors.

15. The method of claim 12, further including controlling the direction of drilling of said first borehole with respect to the location of the coil assembly in response to the determination of the location of the sensors.

16. The method of claim 12, further including repositioning said sensors at multiple locations in said first borehole and repetitively determining the location of the sensors with respect to said coil assembly location to survey said first borehole.

17. A method for surveying a borehole in the earth in spaced relationship to a guide location, comprising:

locating a guide coil assembly at a known location, said guide assembly incorporating an elongated core having a longitudinal axis and having first and second crossed coil windings wrapped longitudinally around said core;

supplying an alternating current to each of said first and second windings to produce alternating current flow in each coil to generate an elliptical magnetic field in the region of a borehole to be drilled;

detecting at sensors located in said borehole vectors of gravity and vectors of the generated electromagnetic field; and determining the distance and direction of said guide assembly from said sensors in response to the detected vectors of the generated magnetic field and the detected gravity vectors.

* * * * *